US010690458B2

(12) United States Patent
Laporte et al.

(10) Patent No.: US 10,690,458 B2
(45) Date of Patent: Jun. 23, 2020

(54) MACHINE FOR LAUNCHING AT LEAST ONE TARGET

(71) Applicant: LAPORTE HOLDING (SAS), Biot (FR)

(72) Inventors: Jean-Michel Laporte, Biot (FR); Jean-Marc Fouques, Calviers (FR)

(73) Assignee: LAPORTE HOLDING (SAS), Biot (FR)

( * ) Notice: Subject to any disclaimer, the term of this patent is extended or adjusted under 35 U.S.C. 154(b) by 0 days.

(21) Appl. No.: 16/085,388

(22) PCT Filed: Mar. 14, 2017

(86) PCT No.: PCT/EP2017/056008
§ 371 (c)(1),
(2) Date: Feb. 4, 2019

(87) PCT Pub. No.: WO2017/157946
PCT Pub. Date: Sep. 21, 2017

(65) Prior Publication Data

US 2019/0154412 A1 May 23, 2019

(30) Foreign Application Priority Data

Mar. 14, 2016 (FR) ..... 16 52090

(51) Int. Cl.
*F41J 9/18* (2006.01)
*F41J 9/24* (2006.01)
(Continued)

(52) U.S. Cl.
CPC . *F41J 9/24* (2013.01); *F41J 9/20* (2013.01); *F41J 9/30* (2013.01)

(58) Field of Classification Search
CPC ..... F41J 9/18; F41J 9/20; F41J 9/24
See application file for complete search history.

(56) References Cited

U.S. PATENT DOCUMENTS 2,996,058 A 8/1961 Ervine
4,146,008 A 3/1979 Rowlands
(Continued)

FOREIGN PATENT DOCUMENTS

FR 2296561 7/1976
FR 2696538 4/1994
(Continued)

OTHER PUBLICATIONS

PCT Request dated May 16, 2017 rom corresponding application No. PCT/EP2017/056008.

*Primary Examiner* — John A Ricci
(74) *Attorney, Agent, or Firm* — Hauptman Ham, LLP

(57) ABSTRACT

A machine for launching at least one target. The machine comprises a launch plate, a launch arm mobile in rotation at least between a supply position, an armed position and an ejection position, a guide element pressing against a first portion of a contour of the target, and a mobile stop exerting a force on a second portion of the contour of the target. The launch arm comprises an ejection portion configured to apply an ejection stress onto a third portion of the target in the armed position, the first, second and third portion being distinct. The launch arm comprises a pin provided with a contact portion configured to contact a fourth portion of the contour of the target in the armed position, the fourth portion being distinct from the other portions.

19 Claims, 7 Drawing Sheets

(51) Int. Cl.

| | |
|---|---|
| ***F41J 9/30*** | (2006.01) |
| ***F41J 9/20*** | (2006.01) |

(56) References Cited

U.S. PATENT DOCUMENTS

| | | | |
|---|---|---|---|
| 5,050,575 | A | 9/1991 | Killion |
| 6,276,350 | B1 | 8/2001 | Davey |
| 2015/0168108 | A1 | 6/2015 | Laporte et al. |

FOREIGN PATENT DOCUMENTS

| | | |
|---|---|---|
| FR | 2787181 | 6/2000 |
| FR | 3016208 | 7/2015 |

MACHINE FOR LAUNCHING AT LEAST ONE TARGET

FIELD OF THE INVENTION

The present invention relates in particular to a machine for launching at least one target, allowing said target to be launched with a precise and repeated trajectory.

A preferred use relates to the industry of shooting sports and in particular to clay target shooting.

TECHNOLOGICAL BACKGROUND

In the field of the industry of shooting sports, machines for launching targets are well known. A plurality of models of target launchers exist and in numerous cases, the accuracy of the ejection of the target is not required. In particular, this is often the case for target launchers having mobility in rotation. For these apparatuses, the machine for launching targets only needs a launch plate, a launch arm and optionally a guide element for guiding the target.

However, when the target launchers are stationary, the repeatability of the trajectories is more often required. For example, for Olympic disciplines or for sporting clays, the repetition of a trajectory by a launcher is crucial for allowing fair competition. Indeed, in these disciplines, it is desired to evaluate competitors solely on their shooting skills. Thus, there must be no discrimination between the competitors through targets that are more or less difficult to hit or have a variable trajectory.

These stationary machines thus integrate, for example, a mobile stop and a guide element.

The main function of the mobile stop is to maintain the target against the launch arm via a return spring. Maintaining the target on the launch arm allows the impacts capable of breaking the target during the sudden acceleration of the arm for the ejection of the target to be prevented.

Also, the rolling of the target in contact with the mobile stop and the launch arm allows the target to be pressed against the guide element.

This solution, is effective when the contour of the target is perfectly smooth, and the launch plate is perfectly dry. Indeed, when the launch plate and/or the contour of the target have increased adhesion, for example like in the presence of water on the launch plate, the target is not positioned against the guide element. This therefore modifies the expected trajectory of the target.

There is therefore a demand for improving the precision of the ejection of a target by a machine for launching targets.

The invention allows all or part of the current technical disadvantages to be overcome.

SUMMARY OF THE INVENTION

One aspect of the invention relates in particular to a machine for launching at least one target, comprising:

- a launch plate configured to support a lower face of the target;
- a launch arm mobile in rotation about an axis of rotation at least between a supply position, an armed position and an ejection position;
- a guide element configured to contact a first portion of a contour of the target in the armed position;
- a mobile stop configured to exert a force on a second portion of the contour of the target in the armed position;

- a machine in which the launch arm comprises an ejection portion configured to apply an ejection stress onto a third portion of the target in the armed position, the first, second and third portion being distinct.

Advantageously, this machine is such that the launch arm comprises a pin provided with a contact portion configured to contact a fourth portion of the contour of the target in the armed position, the fourth portion being distinct from the first, second, and third portion.

This arrangement advantageously allows a fourth stress to be applied onto the target. This stress forces the target to be positioned at a precise position along the launch arm. And those not important the shape of the contour of the target, or of the launch plate. The force exerted by the launch pin thus allows suction cup effects to be prevented for example when the launch plate is wet.

The invention also relates to a machine in which the contact portion is configured to press the target with a non-zero component in the direction of the guide element.

Advantageously and again with the goal of guaranteeing an identical starting position along the launch arm for the target, the contact portion pushes the target against the guide element.

Thus, the target is stopped against the guide element, the launch arm and the pin. The precise position allowing this simultaneous contact is unique. Thus, the target is always positioned at the same location of the launch arm.

The invention also relates to a method for launching at least one target comprising the machine for launching targets and in which the following steps are carried out:

- Supplying the launch arm with at least one target, the step of supplying the launch arm comprising the following steps:
  - providing at least one target onto the launch plate from a magazine;
- first rotation of the launch arm from the supply position during the first rotation:
  - contact between the contact portion of the pin and the fourth portion of the contour of the target;
  - movement of the target under the effect of the pin in a first direction in order to position the second portion of the contour of the target against the mobile stop;
  - sliding of the target, under the combined effect of the thrust exerted by the contact portion and the mobile stop on the target, in a second direction in order to position the third portion of the contour of the target against the guide element;
- stopping of the first rotation in the armed position of the launch arm, the armed position of the launch arm being reached after the sliding of the target, the target being, in said armed position, in simultaneous contact with the contact portion the inner surface of the guide element, the distal end of the mobile stop and the ejection portion;
- second rotation of the launch arm, configured to produce an ejection of the target.

Advantageously, this method allows the repeated and systematic positioning of the target at a precise position on the launch arm. This precise position, coupled with an axis of rotation of the stationary arm, allows an improvement of the control of the trajectory of the target during its ejection.

BRIEF INTRODUCTION OF THE DRAWINGS

Other features, goals and advantages of the present invention will be clear upon reading the following detailed description and in comparison to the appended drawings given as non-limiting examples and in which.

FIGS. 3*a* to 3*e* show the views of steps, allowing the passage from a step of supplying targets to an armed position of the machine for launching targets. These views show these steps including a first embodiment of the invention.

FIGS. 4*a* to 4*f* show the views of steps, allowing the passage from a step of supplying targets to the ejection of the target. These views show these steps including an alternative embodiment of the invention.

FIGS. 5*a* to 5*d* illustrate successive steps of another embodiment of the invention; FIG. 5*e* is a cutaway view of FIG. 5*d;*

Figure 6:
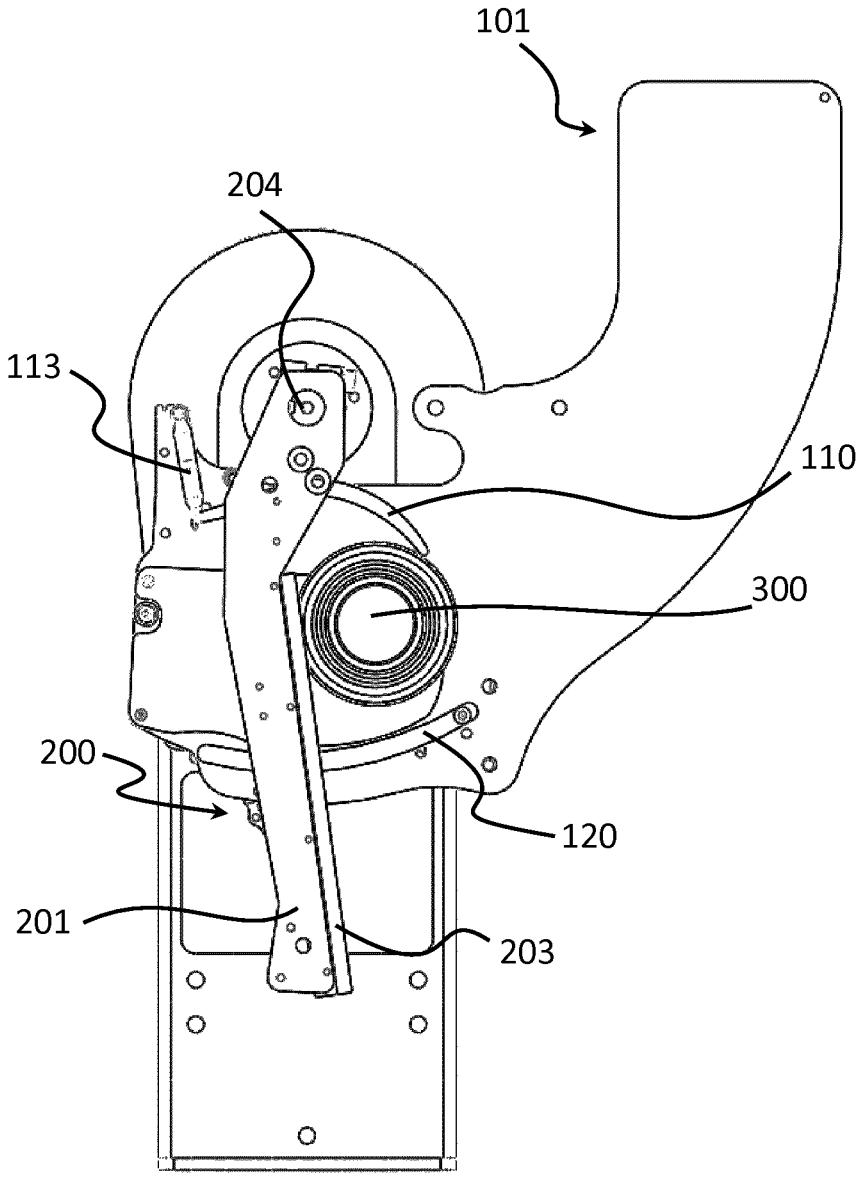

FIG. 6 shows a machine of the prior art.

DETAILED DESCRIPTION

Before going into the details of preferred embodiments of the invention in reference to the drawings in particular, other optional features of the invention, which can be implemented in combination in any combination or alternatively, are indicated below:

- the contact portion is configured to press the target with a non-zero component in the direction of the mobile stop;
- the contact portion of the pin is located closer to the axis of rotation of the launch arm than the ejection portion of said launch arm;
- the contact portion is rectilinear;
- the ejection portion is rectilinear along a longitudinal axis;
- the longitudinal axis and the contact portion of the pin form a non-zero angle $\alpha$.
- the angle $\alpha$ is between 5° and 45°, preferably between 8° and 16° and preferably 12°;
- the pin comprises an elongated body, a distal portion of which at least partially forms the contact portion;
- The pin is made of a single piece
- the coefficient of friction of the ejection portion on the target is greater than that of the contact portion of the pin on the target;
- the material of the pin is advantageously an alloy of aluminum;
- the mobile stop is configured to exert a force on the second portion of the contour of the target in the direction of the ejection portion of the launch arm;
- at least the contact of the machine on at least one out of the first, second, third and fourth portion is in a single point in a plane parallel to a launch-plate plane;
- the end of the step of armed-position passage of the launch arm automatically triggers the second rotation;
- the second rotation is triggered manually by a user.
- the machine comprises a device for freeing the target 300 configured in order for the mobile stop 110 to no longer press the target 300 in a predefined angular position of the arm 200 located downstream of the armed position in the direction of rotation of the arm 200;
- the freeing device comprises a first stop 117 carried by the mobile stop 110 and a second stop 213 carried by the arm 200, the second stop 213 being configured to exert a thrust on the first stop 117 starting from the predefined angular position;
- the second stop 213 is located on the pin 210;
- the second stop 213 is configured in order to no longer exert the thrust on the first stop 117 after a predetermined angular sector following the predefined angular position;
- the predefined angular position is configured to correspond to a position of the target 300 in contact with a portion located at or upstream of a distal end 122 of the guide element 120.

In order to correctly understand the invention:

Pin means a part of any shape against which another part bears or is stopped;

Ejection trajectory means the trajectory followed by a target during its ejection;

Low coefficient of friction means a coefficient of friction lower than that of aluminum on a target, in particular a clay target.

The invention relates to a machine for launching at least one target having a reproducible ejection trajectory. The goal of the invention is therefore to precisely control the ejection trajectory of the target.

The machine for launching targets thus advantageously comprises, a launch plate 100 and a launch arm 200, as well as at least one target 300. Advantageously, the targets 300 are comprised in a magazine (not shown in the drawings). This magazine can in particular be a drum having a plurality of columns with stacks of targets. Thus, the machine can carry a large number of targets 300. This is particularly useful during competitions or for sporting clays. In the preferred embodiment of the invention, the magazine supplies the launch arm 200 with a single target 300 at a time. Examples of components of the invention are given below in a non-limiting manner.

The Target 300

The target 300 can be of the "clay pigeon" type and is preferably suitable for being broken when the shooter hits it. The target 300 comprises a contour 301, a lower face and an upper face of the target 302. Advantageously, the target contains resins. The contour 301 of the target 300 corresponds to the connection portion between the lower face and the upper face of the target 302. Thus, the contour 301 of the target corresponds to the thickness dimension of the target 300. Advantageously and preferably, the upper face 302 and lower face are parallel. In one embodiment of the invention, the upper face 302 and the lower face of the target have identical diameters. In this embodiment, the contour 301 is advantageously in a plane perpendicular to the plane comprising the upper faces 302 and lower faces of the target 300.

In another preferred embodiment of the target 300, the upper face 302 has a diameter smaller than that of the lower face. In this case, the contour 301 can be circular and have a rectilinear or non-rectilinear thickness edge. When the thickness edge of the contour 301 is not rectilinear, it can advantageously comprise at least one step and preferably a succession of steps, configured to reduce the diameter of the contour in the direction of the upper face.

The Launching Support

The launching support comprises a launch plate 100, a mobile stop 110 and a guide element 120.

Advantageously, the launch plate 100 comprises a distal edge 103, a proximal edge 104, a first portion 101, a second portion 102, an inner edge 105, and an outer edge 106.

Preferably, the launch plate 100 is flat. It advantageously comprises a first portion 101 and a second portion 102. The second portion 102 preferably comprises the distal edge 103 of the launch plate 100, said distal edge 103 corresponding to the end not connected to the machine. During the ejection of a target 300, the last portion of the machine in contact with the target 300 is said second portion 102. In order to guarantee a speed and a trajectory as perfect as possible, the second portion 102 is smooth. The goal here being to prevent, as much as possible, the deviations in trajectory caused by obstacles or roughness.

In a preferred embodiment of the invention, the second portion 102 is made of stainless steel or steel with a zinc coating.

The first portion 101 is connected to the machine. It advantageously comprises the proximal end of the launch plate 104. It is said first portion 101 that houses the target 300 when being supplied by the magazine, and it is also this first portion 101 that advantageously supports the mobile stop 110 and the guide element 120. In other embodiments of the invention, the mobile stop 110 and the guide element 120 are carried by the chassis of the machine and not by the launch plate 100.

The launch plate 100 is preferably made of metal, or a metal alloy. Thus, the plate can be made of steel, aluminum or of composite materials.

Advantageously, the launch plate 100 has substantially the shape of an elbow. This elbow shape allows the target 300 to have a support throughout the rotation of the launch arm 200. Nevertheless, in the alternative embodiments of the invention, the launch plate 100 has a different shape. It can for example have the shape of a rhombus.

In the preferred embodiment of the invention and because of its substantially elbowed shape, the edges extending between the distal edge 103 and the proximal edge 104 do not have identical sizes.

Advantageously, the edge extending between the distal edge 103 and the proximal edge 104 having the smallest size is called inner edge 105.

Inversely, the edge connecting the proximal edge 104 and the distal edge 103 having the biggest size is called outer edge 106.

Finally, in the preferred embodiment of the invention, the first portion 101 and the second portion 102 each represent 50% of the total surface area of the launch plate 100. According to other embodiments, the distribution between the first portion 101 and the second portion 102 is not identical.

The Mobile Stop 110

Advantageously, the mobile stop 110 comprises an outer surface 111, an inner surface 112, a return element 113, a distal end 114, a proximal end 115, and an axis of rotation 116.

The mobile stop 110 is advantageously positioned on the first portion 101 of the launch plate 100. More precisely, the mobile stop 110 is positioned near the inner edge 105 on the first portion 101.

The mobile stop 110 advantageously comprises an inner surface 112, an outer surface 111, a distal end 114, a proximal end 115, as well as a return element 113 and an axis of rotation 116.

The mobile stop 110 advantageously has the shape of a claw. Thus, the proximal end 115 of the mobile stop 110 is the end closest to the proximal edge 104 of the launch plate 100. Inversely, the distal end 114 of the mobile stop 110 is the end farthest from the proximal end 115.

Advantageously, between the two ends, the mobile stop 110 has a substantially rectilinear portion and a curved portion. The proximal end 115 is, in this configuration, the end included in the substantially rectilinear portion.

The distal end 114 is the opposite end, that is to say, the end of the curved portion. Since the mobile stop 110 preferably has a curved portion, the inner and outer surfaces connecting each of the ends do not have an identical length. Thus, the longest surface is called outer surface 111. Advantageously, the outer surface 111 is oriented to face the first portion 101 of the launch plate 100. Inversely, the inner surface 112 comprises the smallest dimension between the two ends of the mobile stop 110.

The inner surface 112 is, in this embodiment, facing the outer edge 106 of the launch plate 100.

The distal end 114 of the mobile stop 110 is in contact with the target 300. Preferably, it is the inner surface 112 of the distal end 114 that is in contact with a second portion of the contour 301 of the target 300.

The stop is rotatably mounted on the first portion 101 of the launch plate 100. To do this, said stop comprises, on the substantially rectilinear portion near the curved portion, an axis of rotation 116 visible in FIGS. 3*a* and 4*a* in particular. This axis of rotation 116 is perpendicular to the plane in which the launch plate 100 is comprised.

Advantageously, the proximal end 115 of the mobile stop 110 is connected to a first end of the return element 113. The second end of the return element 113 is advantageously fastened to the launch plate 100.

Preferably, the fastening of the return element 113 is carried out on the first portion 101 of the launch plate 100. More precisely, this return element 113 is fastened near the junction between the inner edge 105 and the proximal edge 104 of the launch plate 100. The return element 113 comprises a deformable portion having a significant coefficient of elasticity. At rest, the return element 113 is configured to maintain the return stop in a first position. For example, the return element 113 can be a spring.

In action, when the mobile stop 110 goes from a first position to a second position, the return element 113 is configured to bring the mobile stop 110 from the second position to the first position. In an advantageous and non-limiting manner, passage of a first position to the passage of a second position of the mobile stop 110 means the movement of the proximal end 115 of the mobile stop 110 towards the outer edge 106 of the launch plate 100. In this configuration, when the proximal end 115 of the mobile stop 110 carries out a movement towards the outer edge 106, the distal end 114 of the mobile stop 110 carries out a movement towards the inner edge 105 of the launch plate 100. This movement being preferably articulated around an axis of rotation 116.

Advantageously, all these features of the mobile stop 110 allow said mobile stop 110 to exert a point of pressure on the contour 301 of the target 300 in the direction of the proximal end 104 of the launch plate 100.

According to an option visible in FIGS. 5*a* to 5*e*, the mobile stop 110 carries a first stop 117 suitable for cooperating with a second stop 213 carried by the pin 210. This participates in forming an embodiment of a device for freeing the target 300 with respect to the mobile stop 110 in an angular position of the arm 200 located downstream of the armed position in the direction of rotation of the arm 200. The stop 117 can be a surface that is stationary with respect to the rest of the mobile stop 110 or, like in FIG. 5*a*, comprise a ring rotatably mounted on an axis rigidly connected to the body of the mobile stop 110.

The Guide Element 120

Advantageously, the launch plate 100 also comprises a guide element 120. The guide element 120 is positioned on the first portion 101 of the launch plate 100. In each of these embodiments, and preferably, the guide element 120 is near the outer edge 106 of the launch plate 100.

Advantageously, the guide element 120 is curved and concave and preferably an arc of a circle. The purpose of the guide element 120 is to guide the target 300 during its ejection by the launch arm 200. Preferably, the guide element 120 is maintained against the launch plate 100 by at least two screws, including one screw at the end of the guide element 120 closest to the distal edge 103 of the launch plate 100. Preferably, the guide element 120 is made from a material having a low coefficient of friction.

In another embodiment of the invention, the guide element 120 is made from any given material, but comprises a coating with a low coefficient of friction.

The contact between the guide element 120 and the target 300 advantageously occurs over a first portion of the contour 301 of the target 300.

The Launch Arm 200

The launch arm 200 advantageously comprises an ejection portion 201, a fastening portion 202 and a pin 210. Advantageously, the fastening portion 202 comprises an axis of rotation of the launch arm 204. This axis of rotation of the launch arm 204 is, in a preferred embodiment of the invention, located outside of the inner edge 105 of the first portion 101 of the launch plate 100. The link between the launch arm 200 and the launching machine is carried out via this axis of rotation 204. In another embodiment of the invention, the axis of rotation of the launch arm 204 is carried by the launch plate 100.

Advantageously, the axis of rotation 204 of the launch arm is perpendicular to the plane comprising the launch plate 100. Preferably, the launch arm 200 is in a plane parallel to the plane comprising the launch plate 100 and preferably above the latter.

The ejection portion 201 of the launch arm 200 can comprise a contact portion 206 configured to press against the target during its thrust. Advantageously, the ejection portion 201 is rectilinear along a longitudinal axis 205. The longitudinal axis 205 preferably extends along the length dimension of the launch arm 200. Advantageously, the longitudinal axis 205 is perpendicular to the axis of rotation of the launch arm 204.

For example, the contact portion 206 is a surface of the launch arm 200 in contact with the target 300. Preferably, the contact between the target 300 and the launch arm 200 occurs on a fourth portion of the contour 301 of the target 300.

In a preferred embodiment of the invention, the contact portion 206 comprises a strip 203. In this embodiment, the strip 203 is interposed between the target 300 and the contact portion 206. It is in particular this embodiment that is shown in the drawings. In an advantageous and non-exhaustive manner, the strip 203 consists of a material having a high coefficient of friction or comprises a coating having a high coefficient of friction. The material or the coating of the strip 203 can thus be for example an elastomer (rubber, polyurethane).

According to one embodiment, the arm 200 comprises a main body, for example made of metal, connected to a shaft that drives it in rotation, at the axis 204.

The Pin 210

In the preferred embodiment of the invention, the pin 210 is a part exerting an additional force on the target, in particular by modifying the angle between the ejection portion 201 and the target 300. It was mentioned above that a portion of the ejection portion 201 is preferably rectilinear according to with a longitudinal axis 205. It thus has an angle of 0°. The pin 210, in the preferred embodiment of the invention, modifies this angle on another portion of the arm. The pin 210 comprises, in a preferred case, a rectilinear contact portion 211. Thus, the ejection portion 201 no longer follows a single line, but comprises an angle called $\alpha$. This angle $\alpha$ can be between 5° and 45° and is preferably 12°. The angle $\alpha$ being advantageously oriented towards the axis of rotation of the launch arm 204.

The pin 210 is advantageously made from a material having a low coefficient of friction, or has a coating with a low coefficient of friction. In this embodiment, the pin 210 can be a connected element fastened to the launch arm 200 in a plurality of ways. For example, a portion of the pin 210 can extend under the launch arm 200 and be fastened below. For example, if the arm 200 comprises a main body, the pin 210 can be connected to the lower face of the body; it thus forms an extra thickness on the arm 200, oriented opposite the launch plate 100. FIG. 5*e* makes this option clear, with a pin 210 in the form of a plate connected under the body of the arm, via its lower face.

In another hypothesis, the pin 210 can be fastened directly onto the thickness edge of the launch arm 200. In any case, the pin 210 is in contact with a fourth portion of the contour 301 of the target 300. Advantageously, this modification of the angle of the contact portion with the target 300 allows, during the rotation of the launch arm 200, a force to be exerted on the target 300 that moves said target 300 towards the guide element 120. And more precisely towards the end of the guide element closest to the distal edge 103 of the launch plate 100.

The advantage of this embodiment is that the pin 210 is suitable for all the diameters of targets.

Finally, in another embodiment, the pin 210 and the launch arm 200 are formed from a single part.

In a third embodiment of the invention, the pin 210 is made from an elongated element, for example in the shape of an elbow. In this embodiment, the pin 210 comprises an end for contact with the target. Advantageously, this contact end is made from a material or comprises a coating having a low coefficient of friction. Moreover, a wheel can be present at the contact end in order to carry out said contact. In this embodiment, the end of the pin 210 opposite to the contact end is mounted on launch arm 200. Moreover, this other end is preferably articulated about an axis of rotation of the pin. The axis of rotation of the pin being parallel to the axis of rotation of the arm 204. In this embodiment, the elbow is oriented towards the inner edge 105 of the launch plate 100. The main advantage of this elbow shape is to accentuate the thrust of the pin 210 against the target 300 in the direction of the guide element 120.

The purpose of the pin 210 still being to force the target 300 to be positioned against the guide element 120. In this embodiment, the pin 210 is advantageously articulated in rotation in order to adapt to all the diameters of targets. The adaptation to said diameter can be carried out manually. In this case, a user adjusts the pin 210 in order for its contact end to press the target 300 and tightens the other end of the pin via for example a screw or a nut.

In the rest of the description, other alternative embodiments of the pin 210 are given, in particular in reference to FIGS. 5*a* to 5*e*.

The Positioning of the Points of Contacts with the Target 300

According to the preferred embodiment of the invention, the lower surface of the target 300 is in a plane parallel to the plane comprising the launch plate 100. Nevertheless, the target 300, resting on the launch plate 100, is above said launch plate.

In an advantageous but non-limiting manner, the mobile stop 110 and more particularly the distal end 114 and the guide element 120 and more particularly the inner surface of the guide element 121 are in a plane that is similar, and parallel to the plane of the launch plate 100. This plane is positioned with respect to the target 300 above the lower surface, but on a lower portion of the contour 301 of the target 300. Thus, the contacts of the first and second portion of the contour 301 of the target 300 with the inner surface of the guide element 121 and the distal end 114 occur on the lower portion of the contour 301 of the target 300.

In the case in which the contour 301 of the target 300 comprises at least one step, then the contact between the first and the second portion of the contour of the target with, respectively, the inner surface of the guide element 121 and the distal end 114 occurs on one of the first steps starting from the lower surface of the target. Preferably, the contacts occur on the first step starting from the lower surface of the target.

In the preferred embodiment of the invention, the ejection portion 201 and the pin 210 are provided for bearing in the same plane parallel to the plane of the launch plate 100. In this embodiment, the ejection portion 201 and the pin 210 contact, respectively, the third and the fourth portion of the contour 301 of the target 300. The third and the fourth portion are advantageously located on an upper portion of the contour 301 and thus above the first and second portion of the contour 301 of the target 300. In an alternative embodiment of the invention, the launch arm 200 and the pin 210 are in parallel planes located one above the other. In this embodiment, the pin 210 is advantageously on the launch arm 200.

Other embodiments are of course possible for the operation of the invention, for example such as assigning independent parallel planes to the ejection portion, to the pin 210, the inner surface of the guide element 121 and to the distal end 114. Nevertheless, in all these embodiments, the launch arm 200 and the pin 210 is in one or more planes located above the plane(s) of the distal end 114 and of the inner surface of the guide element 121. The purpose of this offset is that during the rotation of the launch arm 200, the latter can pass above the guide element 120 and the mobile stop 110.

In general, the four bearing portions of the target should be located in angularly distinct zones of the target. That is to say, at different locations on this advantageously circular contour 301.

The use of the machine for launching targets advantageously comprises a supply step, a step of the launch arm 200 going into the armed position and a position of ejection of the target 300.

The Supply Step

At the beginning of the supply step (FIGS. 3*a* and 4*a*), the target is provided by a magazine (not shown in the drawings) and rests on the first portion 101 of the launch plate 100. Advantageously, the target 300 rests on its lower surface. Preferably, during this step, the target is not in contact with the launch arm 200, the pin 210, the mobile stop 110 or the guide element 120. Again in this embodiment, it is, however, surrounded by the launch arm 200, the pin 210, the mobile stop 110 and the guide element 120.

In another embodiment of the invention, the contour 301 of the target is in contact with the proximal edge 104 of the launch plate 100 and the proximal end 115 of the mobile stop 110.

The launch arm 200 then carries out a first rotation. The purpose of the direction of this rotation being to bring the ejection portion 201 of the launch arm 200 closer to the distal end 103 of the launch plate 100 while passing above the guide element 120.

Figure 1:
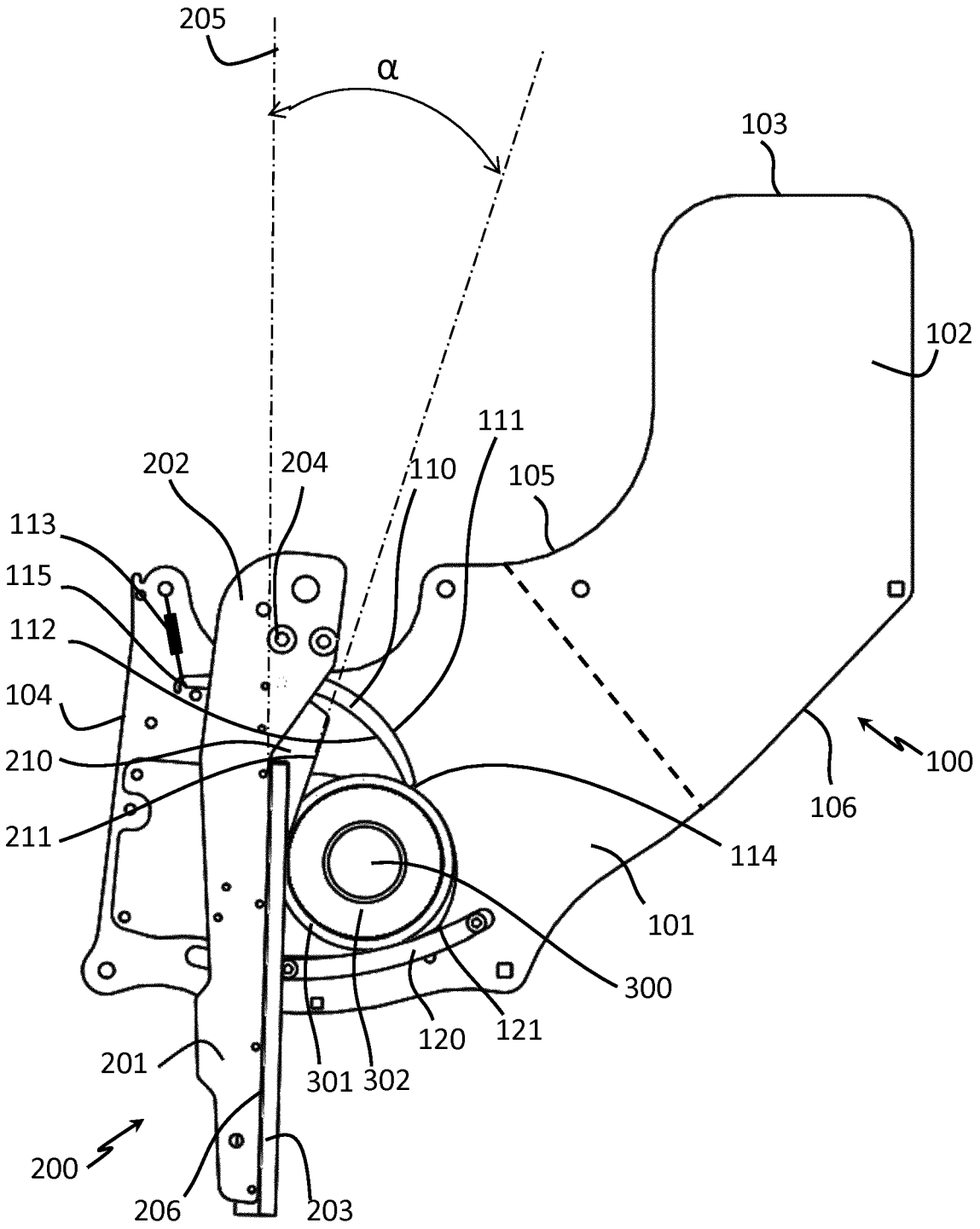
FIG. 1 shows a preferred embodiment of the invention in which the pin comprises a rectilinear contact portion.
Figure 2:
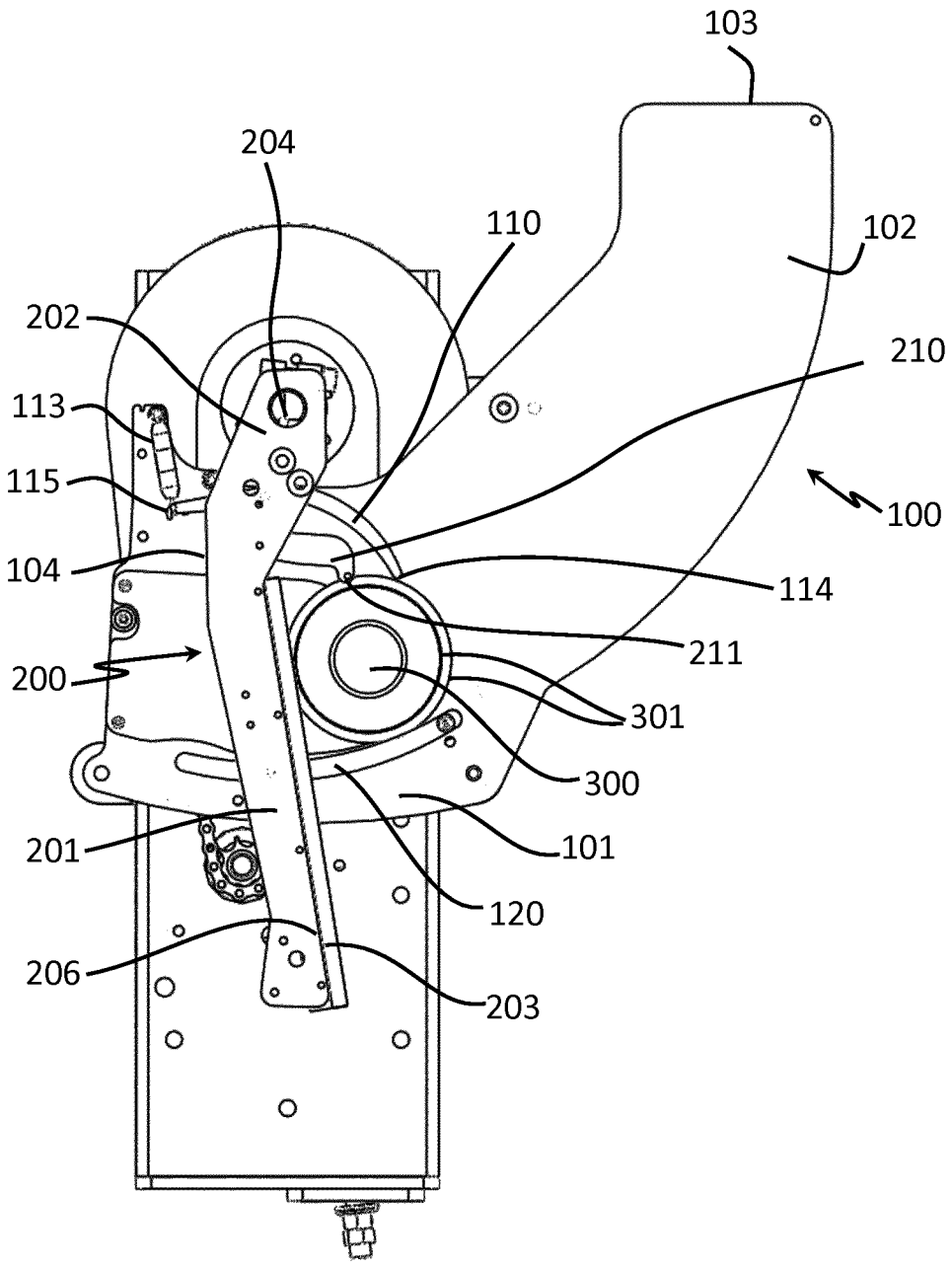
FIG. 2 is a top view of an alternative embodiment of the invention in which the pin has the shape of an elbow.
Figure 3A:
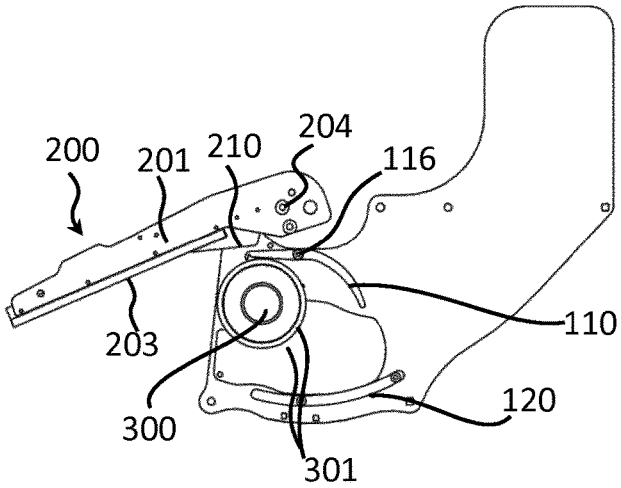
Figure 3B:
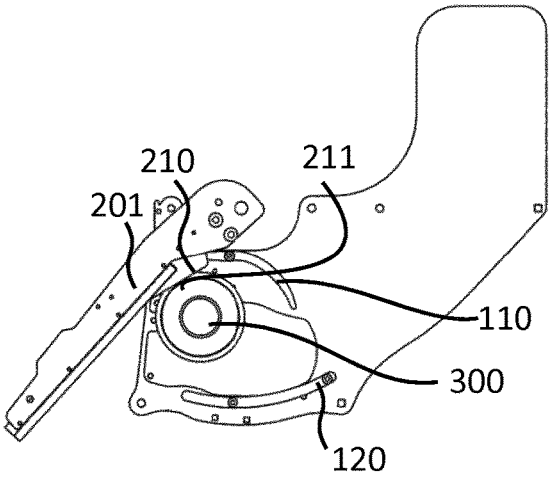
Figure 3C:
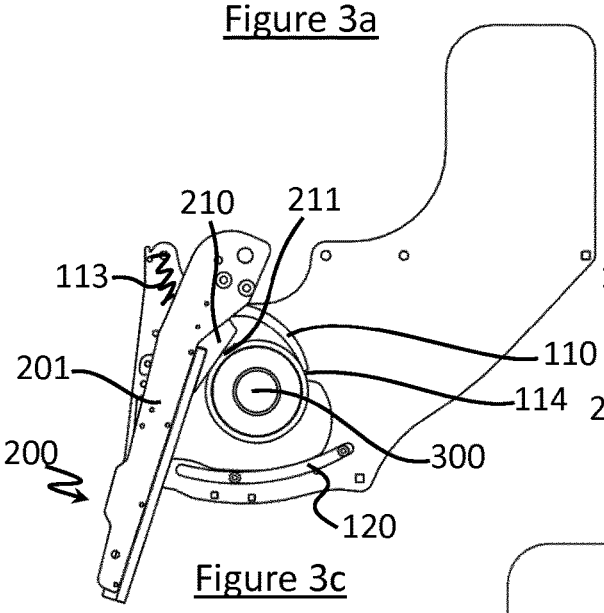
Figure 3D:
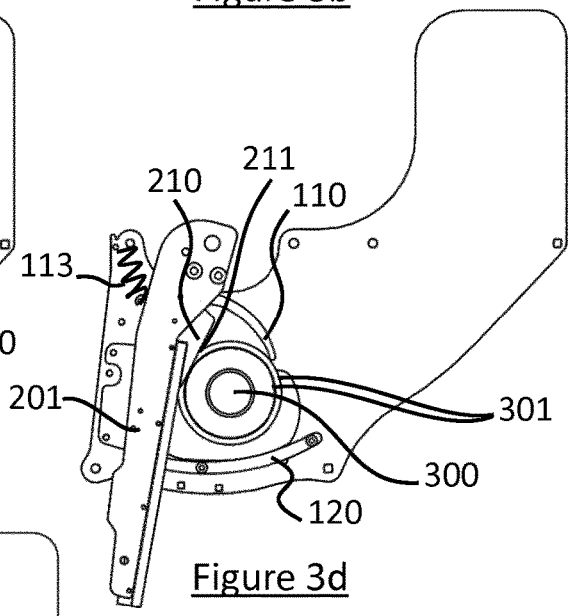
Figure 4A:
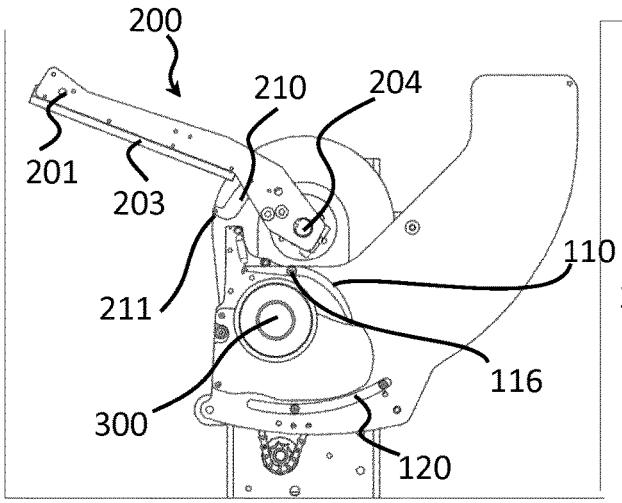
Figure 4B:
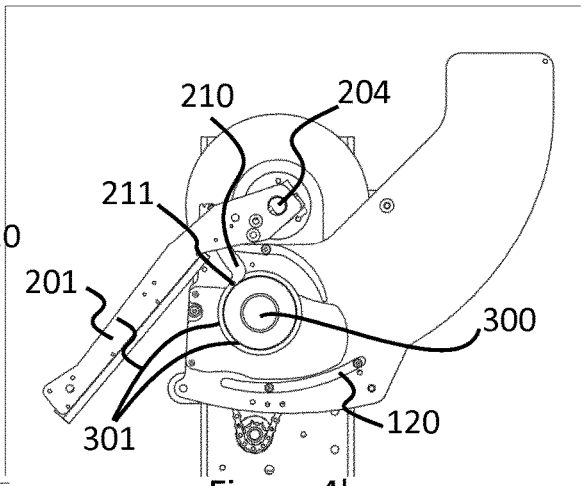
Figure 4C:
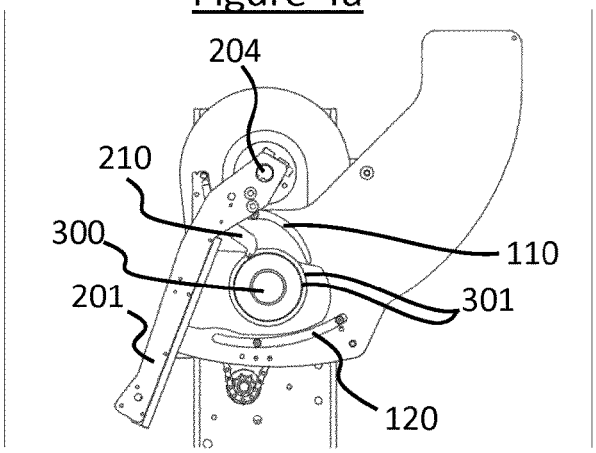
Figure 4D:
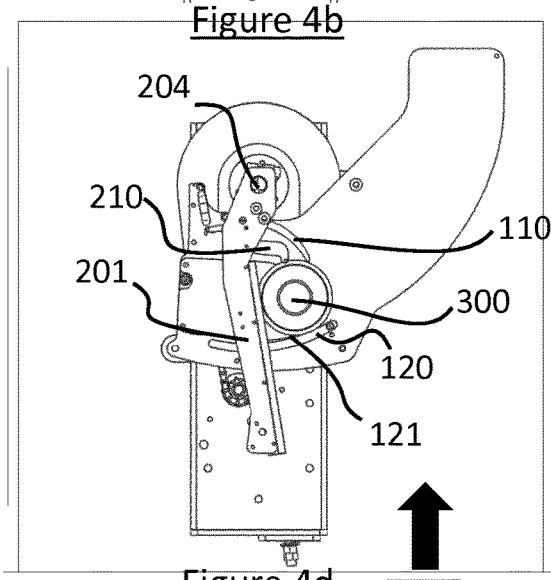

During this first rotation, the pin 210 comes into contact with the fourth portion of the contour of the target 300 (FIGS. 3*b* and 4*b*). This contact allows the pin 210 to exert a thrust on the target 300. This thrust is advantageously carried out via the contact portion 211. The thrust exerted advantageously allows the target 300 to move towards the distal end 114 of the mobile stop 110 (FIG. 3*c*), in particular in order for said distal end 114 to enter into contact with a first portion of the contour 301 of the target 300. Then, during the continuation of the rotation of the launch arm 200, the force exerted together by the pin 210 and the mobile stop 110 forces the target 300 to move towards the guide element 120 (FIGS. 3*d* and 4*c*). The mobile stop 110 is suitable for exerting a force due to its return element 113. It is also important to note that the fourth and second portion of the contour 301 of the target 300 are not diametrically opposed. This advantageous configuration allows the target to be clamped. Since the pin 210 and the end of the mobile stop 110 have a low coefficient of friction, this clamping allows the sliding of the target towards the guide element 120 and more precisely towards the inner surface of the guide element 121.

Passage of the Launch Arm 200 into the Armed Position.

The guide element 120 and more precisely towards the inner surface of the guide element 121 then comes into contact with the second portion of the contour 301 of the target 300 (FIGS. 1, 2, 3*e* and 4*d*). At this moment, the launch arm 200 and more precisely the ejection portion 201, and preferably the strip 203 also comes into contact with the third portion of the contour 301 of the target 300. This last step corresponds to the passage of the launch arm 200 into the armed position. Advantageously, in the armed position, the target 300 is simultaneously in contact with the ejection portion 201, the distal end 114 of the mobile stop 110, the guide element 120 and the pin 200. In an alternative embodiment, the pin 200 is no longer in contact with the target 300.

The Ejection of the Target 300

Figure 3E:
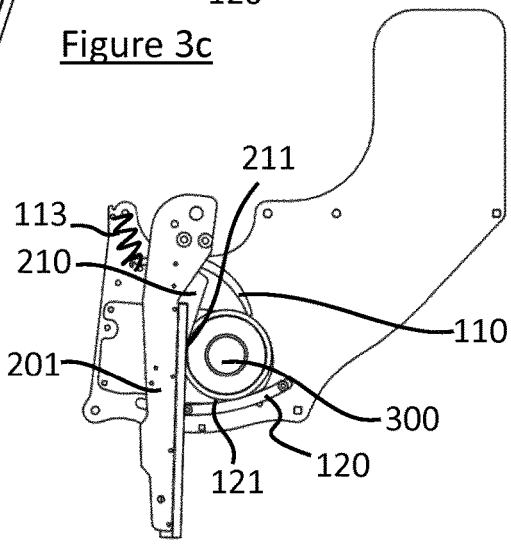
Figure 4E:
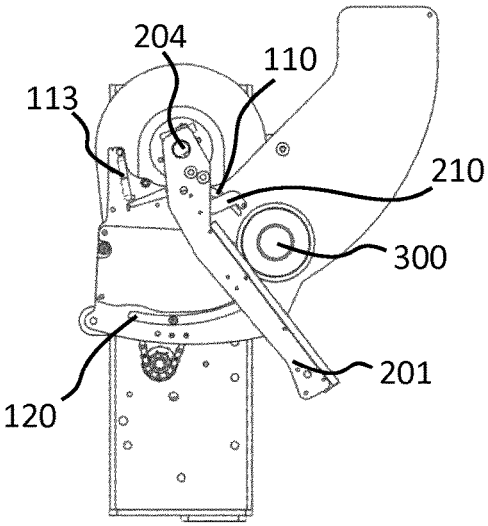
Figure 4F:
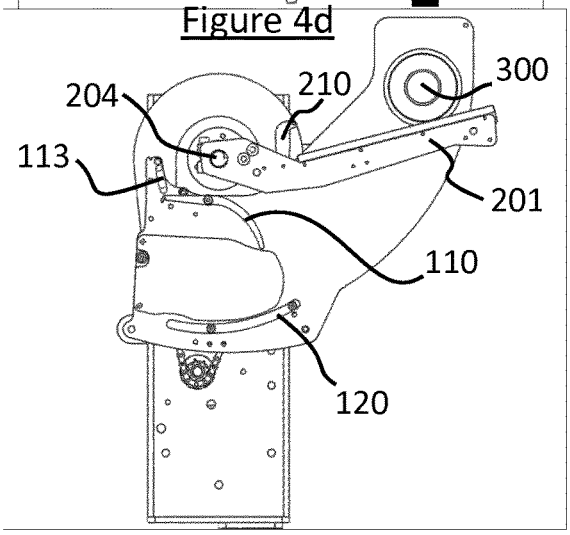

The step of ejection of the target 300 can be automatically carried out after the step of arming the launch arm. It can also, in another embodiment of the invention, be triggered manually by a user. During the ejection step, the launch arm 200 carries out a second rotation in a direction similar to the first. During this second rotation, the target 300 rolls along the guide element and loses its contact with the pin 210 and the mobile stop 110. Thus, the target advantageously passes over the second portion 102 of the launch plate 100 in the direction of the distal edge 103, and thus on the side of the outer surface 111 of the mobile stop (FIGS. 3*e*, 4*e* and 4*f*).

FIGS. 5*a* to 5*e* present an additional embodiment based on an alternative of the embodiment of FIGS. 3*a* to 3*f*. According to this other example, the pin 210 comprises, in addition to the portion 211 for contact with the target 300, a second stop 213. Preferably, the second stop 213 is formed by a portion of the thickness edge of the pin 210 in particular located more towards the axis of rotation 104 than the contact portion 211. In reference to FIG. 5*a*, the second stop 213 comprises a rectilinear portion between a first end 214 and a second end 215. Preferably, a rounded portion is formed at at least one of the ends 214, 215. In the case of the aforementioned figure, the pin 210 is such that the portion of 111 and the second stop 213 cooperate.

The mobile stop 110 comprises a first stop 117 configured to cooperate via contact with the second stop 213. In the case illustrated, the first stop 117 is a pin protruding from the body of the mobile stop 110 towards the arm 200. Preferably, the first stop 117 is positioned on the mobile stop 110 between the axis of rotation 116 and the distal end 114.

Figure 5A:
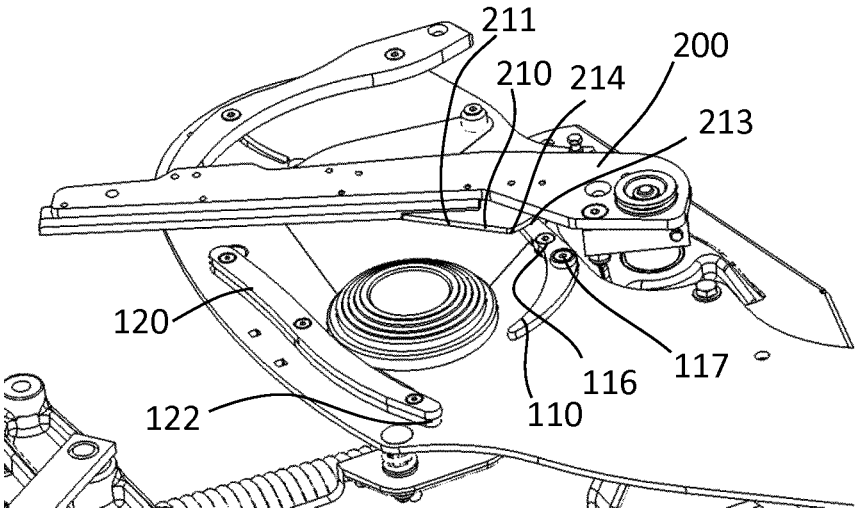
Figure 5B:
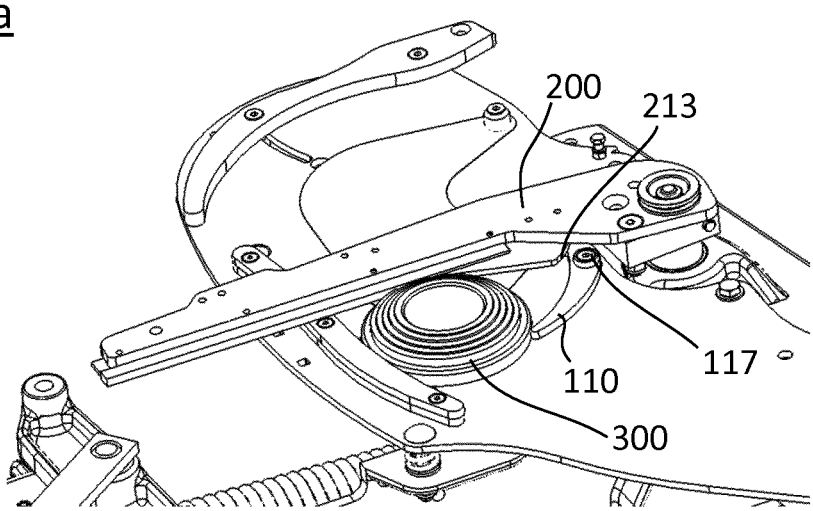
Figure 5C:
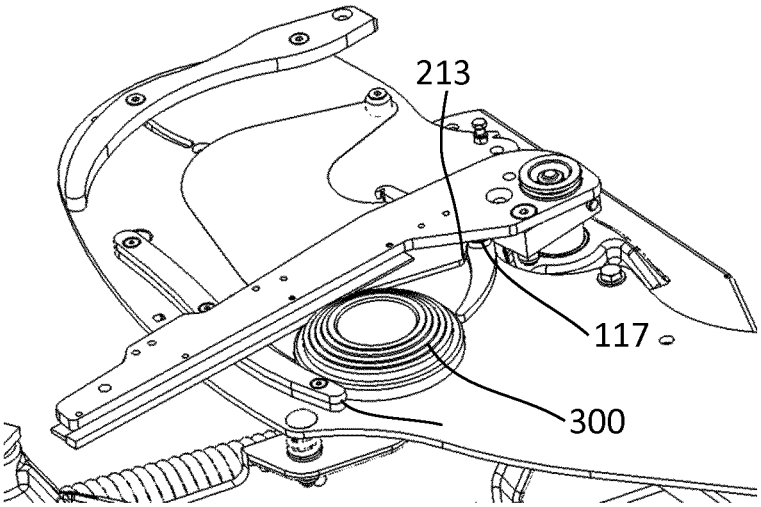

In the case shown in FIGS. 5*a* and 5*b*, the first stop 117 and the second stop 213 are not in contact with one another. The operation of the mobile stop and of the pin 210 thus corresponds to the descriptions given above, in particular in reference to the embodiment illustrated in FIGS. 3*a* to 3*f*. In FIG. 5*c*, the first stop 117 and the second stop 213 press against each other, due to the rotation of the arm 200 that tends to bring these 2 portions closer together during the phase of thrust on the target 300. Preferably, this beginning of contact between the 2 stops occurs when the target 300 reaches the distal end 122 of the guide element 120, or before, or after, in particular in an angular sector of rotation of the arm 200 between −10° and 10° around the position of the arm in which the target 300 is in contact with the distal end 122 of the guide element 120. Such a situation is visible in FIG. 5*c*.

Figure 5D:
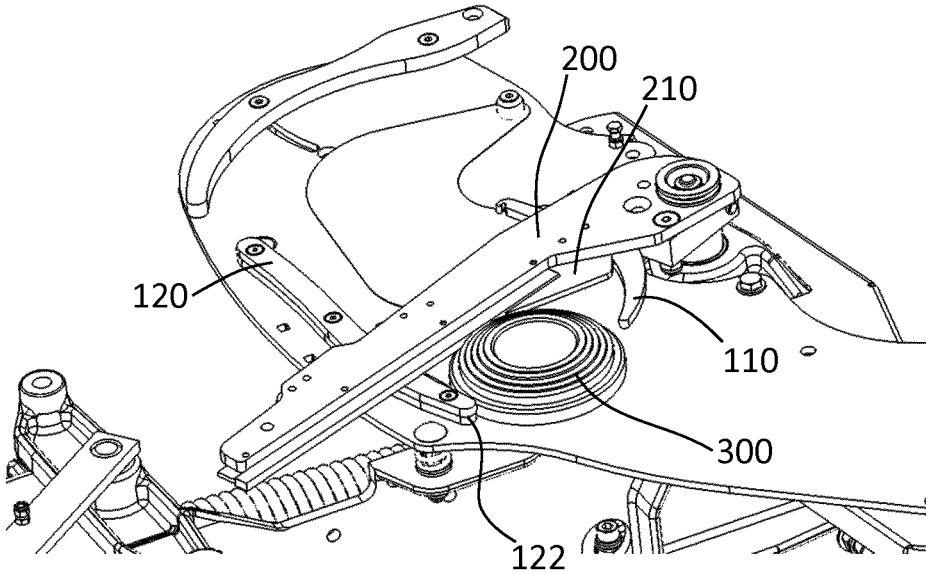
Figure 5E:
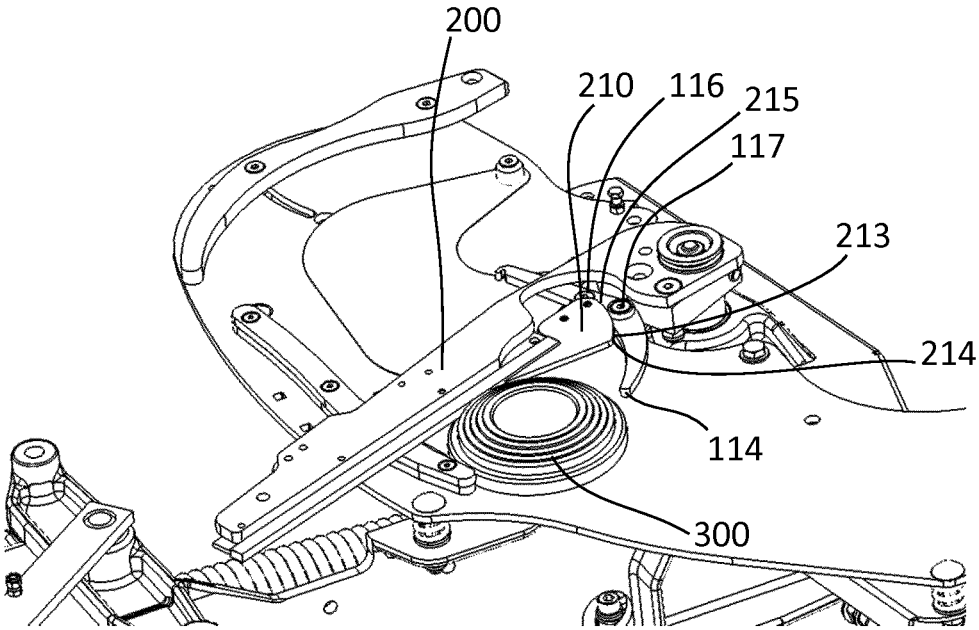

FIG. 5*d* shows that the continuation of the rotation of the arm 200 leads to a thrust of the second stop 213 against the first stop 117 in such a way that the contact previously established between the target 300 and the distal end 114 of the mobile stop 110 is released. Indeed, it is advantageous for the bearing exerted by the mobile stop 110 on the target 300 to be deactivated as soon as contact is no longer made with the target 300 by the guide element 120. Thus, it is guaranteed that no parasite thrust of the mobile stop 110 on the target 300, which could tend to move the latter towards the free end of the arm 200, can occur. The precision of the launcher can thus be improved.

Later, with the continuation of the rotation of the arm 200, with the relative movement of the first stop 117 along the second stop 213, the first stop 117 progressively arrives at the second end 215 of the second stop 213. When moving beyond the end 215, the stop 117 is more constrained by the movement of the arm 200 and can go back to its initial position via the application of the return effect of the spring 113. It is noted that the first stop 117 is advantageously configured to not interfere with the other portions of the arm 200 during the continuation of the rotation. For this purpose, for example, the stop 117 can protrude beyond the body of the mobile stop 110 only over a thickness such that the stop 117 does not go beyond the thickness of the thickness edge of the pin 210. FIG. 5*e* shows an arrangement of the arm that allows this aspect, with a pin 210 connected under the body of the arm 200 and forming, via its thickness edge, the stop 213.

The invention is not limited to the embodiments described above and extends to all the embodiments that correspond to the spirit of the invention.

Thus, the invention can also comprise the embodiments in which for example, the mobile stop 110 and/or the guide element 120 are absent, but also embodiments or the mobile stop 110 and the guide element 120 are not carried by the launch plate 100, but directly by the chassis of the machine. Moreover, other embodiments for the guide element 120 and the mobile stop 110 are possible. Indeed, in alternative embodiments, these elements are not curved but rectilinear. The goal still being to apply forces to the target 300 in order to move it against the guide stop 120.

REFERENCE

100. Launch plate
101. First portion
102. Second portion
103. distal edge
104. Proximal edge
105. Inner edge
106. Outer edge
110. Mobile stop
111. Outer surface
112. Inner surface
113. Return element
114. Distal end
115. Proximal end
116. Axis of rotation
117. First stop
120. Guide element
121. Inner surface of the guide element
122. Distal end
200. Launch arm
201. Ejection portion
202. Fastening portion
203. Strip
204. Axis of rotation of the launch arm
205. Longitudinal axis
206. Contact portion
210. Pin
211. Contact portion
213. Second stop
214. First end
215. Second end
300. Target
301. Contour of the target
302. Upper face of the target

The invention claimed is:

1. A machine for launching at least one target, comprising:

a launch plate configured to support a lower face of the target;

a launch arm mobile in rotation about an axis of rotation at least between a supply position, an armed position and an ejection position;

a guide element configured to contact a first portion of a contour of the target in the armed position;

a mobile stop configured to exert a force on a second portion of the contour of the target in the armed position;

and wherein a machine in which the launch arm comprises an ejection portion configured to apply an ejection stress onto a third portion of the contour of the target in the armed position, the first portion, second portion and third portion being distinct; and wherein the launch arm comprises a pin provided with a contact portion configured to contact a fourth portion of the contour of the target in the armed position, the fourth portion being distinct from the first portion, second portion, and third portion, wherein the contact portion is rectilinear.

2. The machine according to claim 1, wherein the contact portion is configured to press the target with a non-zero component in the direction of the guide element.

3. The machine according to claim 2, wherein the contact portion is configured to press the target with a non-zero component in the direction of the mobile stop.

4. The machine according to claim 1, wherein the contact portion of the pin is located closer to the axis of rotation of the launch arm than the ejection portion of said launch arm.

5. The machine according to the claim 1, wherein the ejection portion is rectilinear along a longitudinal axis, and wherein the longitudinal axis and the contact portion of the pin form a non-zero angle $\alpha$.

6. The machine according to claim 5, wherein the angle $\alpha$ is between 5° and 45°.

7. The machine according to claim 1, wherein the pin comprises an elongated body, a distal portion of which at least partially forms the contact portion.

8. The machine according to claim 1, wherein the coefficient of friction of the ejection portion on the target is greater than that of the contact portion of the pin on the target.

9. The machine according to claim 1, wherein the material of the pin is an alloy of aluminium.

10. The machine according to claim 1, wherein the mobile stop is configured to exert a force on the second portion of the contour of the target in the direction of the ejection portion of the launch arm.

11. The machine according to claim 1, wherein at least a contact of the machine on at least one out of the first portion, second portion, third portion and fourth portion consists in a single point in a plane parallel to a launch-plate plane.

12. The machine according to claim 1, comprising a device for freeing the target configured in order for the mobile stop to no longer press the target in a predefined angular position of the launch arm located downstream of the armed position in direction of rotation of the launch arm.

13. The machine according to claim 12, wherein the freeing device comprises a first stop carried by the mobile stop and a second stop carried by the launch arm, the second stop being configured to exert a thrust on the first stop starting from the predefined angular position.

14. The machine according to claim 13, wherein the second stop is located on the pin.

15. The machine according to claim 13, wherein the second stop is configured in order to no longer exert the thrust on the first stop after a predetermined angular sector following the predefined angular position.

16. The machine according to claim 12, wherein the predefined angular position is configured to correspond to a position of the target in contact with a portion located at or upstream of a distal end of the guide element.

17. A method for launching at least one target comprising the use of a machine for launching targets according to claim 1 and in comprising:

supplying the launch arm with at least one target, the step of supplying the launch arm comprising:

providing at least one target onto the launch plate from a magazine;

operating a first rotation of the launch arm from the supply position;

during the first rotation:

contacting the contact portion of the pin and the fourth portion of the contour of the target;

moving the target under the effect of the pin in a first direction in order to position the second portion of the contour of the target against the mobile stop;

sliding the target, under the combined effect of the thrust exerted by the contact portion and the mobile stop on the target, in a second direction in order to position the third portion of the contour of the target against the guide element;

stopping the first rotation in the armed position of the launch arm, the armed position of the launch arm being reached after the sliding of the target, the target being, in said armed position, in simultaneous contact with the contact portion, a inner surface of the guide element, a distal end of the mobile stop and the ejection portion;

operating a second rotation of the launch arm, configured to produce an ejection of the target.

18. The method according to claim 17, wherein the second rotation is triggered by any of the following methods:

automatically upon reaching the armed-position of the launch arm; or manually by a user.

19. The method according to claim 17, comprising freeing the target configured in order for the mobile stop to no longer press the target in a predefined angular position of the arm (200) located downstream of the armed position in the direction of rotation of the arm.

* * * * *